US006533870B1

(12) United States Patent
Granström et al.

(10) Patent No.: US 6,533,870 B1
(45) Date of Patent: Mar. 18, 2003

(54) ROAD SURFACE MARKING TAPE FOR TEMPORARY USE AND A METHOD OF SUCH USE

(75) Inventors: Inga-Lena Granström, Trelleborg (SE); Jonas Svensson, Beddingestrand (SE)

(73) Assignee: Trelleborg Industri AB, Trelleborg (SE)

( * ) Notice: Subject to any disclaimer, the term of this patent is extended or adjusted under 35 U.S.C. 154(b) by 0 days.

(21) Appl. No.: 09/623,605

(22) PCT Filed: Mar. 8, 1999

(86) PCT No.: PCT/SE99/00345

§ 371 (c)(1),
(2), (4) Date: Sep. 5, 2000

(87) PCT Pub. No.: WO99/46447

PCT Pub. Date: Sep. 16, 1999

(30) Foreign Application Priority Data

Sep. 3, 1998 (SE) ..... 9800764

(51) Int. Cl.[7] ..... B08B 7/02; B08B 7/04

(52) U.S. Cl. ..... 134/17; 134/6; 134/16; 134/21

(58) Field of Search ..... 404/12, 14; 428/141, 428/142, 143, 147; 134/6, 21, 16, 17

(56) References Cited

U.S. PATENT DOCUMENTS

| | | | | | |
|---|---|---|---|---|---|
| 4,279,056 | A | | 7/1981 | Jacobson, Jr. et al. | |
| 4,282,281 | A | | 8/1981 | Ethen | |
| 4,299,874 | A | | 11/1981 | Jones et al. | |
| 4,490,432 | A | * | 12/1984 | Jordan | 404/14 |
| 4,584,044 | A | * | 4/1986 | Tokunaga et al. | 126/263.01 |
| 4,648,689 | A | * | 3/1987 | May | 359/538 |
| 5,087,148 | A | * | 2/1992 | Wyckoff | 404/12 |
| 5,139,590 | A | * | 8/1992 | Wyckoff | 156/209 |
| 5,316,406 | A | * | 5/1994 | Wyckoff | 404/12 |
| 5,605,381 | A | | 2/1997 | Schmoock, Jr. et al. | |
| 5,679,437 | A | * | 10/1997 | Hackworth et al. | 359/538 |
| 5,981,033 | A | * | 11/1999 | Haunschild et al. | 404/12 |
| 6,204,350 | B1 | * | 3/2001 | Liu et al. | 427/195 |
| 6,211,260 | B1 | * | 4/2001 | Nakamura et al. | 522/100 |

FOREIGN PATENT DOCUMENTS

| | | |
|---|---|---|
| EP | 0304405 A1 | 2/1989 |

* cited by examiner

*Primary Examiner*—Alexander Markoff
(74) *Attorney, Agent, or Firm*—Burns, Doane, Swecker & Mathis, LLP

(57) ABSTRACT

The invention relates to a road surface marking tape intended for temporary use and being of the kind that includes a base layer of non-cured or non-vulcanized soft elastomeric material, and reinforcing material embedded in the base layer. The reinforcing material is comprised of short fibers of non-metallic material distributed generally uniformly in the base layer in an amount corresponding to 5–50%, preferably 10–20% of the weight of the base layer. The reinforcing material is preferably comprised of fibers of fabric, plastic or carbon with lengths generally between 0.5 and 5 mm, preferably between 1 and 3 mm. The elastomeric material is usually a rubber of the acrylnitrile-butadiene type. The invention also relates to a method of temporarily marking the surface of a road or highway with the aid of the inventive tape, wherein the tape is applied to said surface in the form of an elongated web taken from a tape reel with the aid of an appropriate mechanical tape-laying device, and removed when the traffic markings are no longer required, by freezing the tape to a brittle state and disintegrating the tape to a powder form and collecting said powder mechanically. Freezing, disintegration and collection of the tape material can be effected mechanically in one single step. The tape is conveniently disintegrated by brushing with a rotating steel brush or the like, and the resultant tape scrap is removed by suction.

12 Claims, No Drawings

ROAD SURFACE MARKING TAPE FOR TEMPORARY USE AND A METHOD OF SUCH USE

The present invention relates to road surface marking tape for temporary use in marking out temporary traffic diversions and comprising a base layer of nonvulcanized or non-cured soft elastomeric material and a reinforcing material embedded in the base layer. The present invention also relates to a method marking road surfaces with the aid of such tape.

It is known to use to mark the surfaces of roads, highways, etc., with a foil material which is based on a polymeric base layer, for instance a resin, thermoplastic, thermoelastomeric or rubber material, that includes a heavily light-reflecting layer which includes pigments, colorants, and/or glass beads embedded either in the base layer or in an upper layer adjacent said base layer, or in both of said layers. Such materials are described, for instance, in U.S. Pat. Nos. 2,440,584, 3,764,455, 3,915,771, 4,117,192, 4,248,932, 4,282,281 and 4,299,874, and also in EP-A 614503 and SE-B 458215. A common feature of all of the known materials described in said publications is that they are intended for permanent use and are thus designed and adapted for such use. The most important properties required of such road surface marking foils lie in their high mechanical strength, i.e. high wear strength, high abrasive resistance with respect to their reflective layers, a long useful life, etc. The base layer has therefore been designed to meet these requirements. As a result such road surface marking foils are relatively rigid and will have certain drawbacks with respect to compatibility and conformity to the state of the road surface on which they are laid, and also with respect to their ability to effectively adhere to and lie in tight abutment with said surface, even when a soft polymeric material is used. Consequently, it is preferable in the majority of cases, at least in normal outdoor temperatures in a temperate climate, to apply a primary layer consisting of a rubber solution or the like prior to applying the foil to the road surface. Such road surface marking materials are unsuitable for applications where only a temporary marking is required, for instance over a time period of up to 10–12 months, for a number of reasons. Such materials are not easily removed without leaving any trace, due to the use of the primer. The primer is absolutely necessary in achieving effective adhesion, since the marking material is relatively thick and thus also relatively stiff and difficult to "mold" to the irregularities of the road surface, as inferred above. These materials are also highly expensive and are discarded as waste when their use is fulfilled. The waste material is also difficult to handle in a manner that is environmentally acceptable.

There is thus a need to be able to use foil-type road-surface marking material, hereinafter called road marking tape, also for temporary purposes instead of needing to use less effective and less traffic-safe markings with loose or firmly mounted cones or other similar "mechanical" solutions, or by painting directly on the road surface, such painted markings being difficult to erase when no longer required. Although various types of temporary road-marking materials based on metal foil, for instance aluminium foil, are now commercially available, these materials are relatively expensive and do not have sufficient strength and wear resistance. The removal of such materials from a road surface also presents serious problems when said materials have been applied to said surface with the aid of a strong adhesive.

Road-surface marking tape of the kind defined in the introduction and primarily intended for temporary use in diverting road traffic is described in EP-A 0304405. The tape contains a very soft and formable non-cured elastomer based on acrylnitrile-butadiene which forms a base layer having a thickness of about 0.5 mm. This layer is much thinner than corresponding layers of earlier used permanent tapes and is therefore considered to have properties which enable the tape to be laid directly on the road surface with good adhesion and conformity with respect to irregularities in the road surface. However, the preferred embodiments include an adhesive layer on the undersurface of the tape for effective adhesion of the tape to said surface, such adhesive layers probably being always used in practice. The base layer contains both pigments and glass beads which provide the tape with the desired optical reflective properties. The base layer is reinforced with a strengthening layer which is embedded at least partially into the elastomeric base layer, in order to facilitate handling of the tape in practice on the one hand and, on the other hand, to impart to the tape the mechanical strength properties required when laying-out the tape, such as high tensile strength and appropriate ultimate tensile strength so that tape can be torn away from said road surface when necessary. The reinforcing layer is said to have the form of a plastic, metal or fabric net, preferably with square or rectangular meshes. According to the main Claim of said patent publication, it is necessary for the reinforcing layer to be embedded at least partially in the base layer.

Although the reinforcing layer solves certain strength problems, primarily with respect to removing the tape—which is done manually—by tearing up the tape piece-by-piece until all of the tape has been removed, it creates other problems relating to the ability to mold the base layer to irregularities in the road surface and therewith enable the tape to be placed in tight abutment with said surface for effective and durable adhesion thereto. Thus, although without being specifically mentioned, the reinforcement has on the base layer a mechanically stiffening effect that reduces the mouldability or shaping ability of the tape and therewith deleteriously affects the conditions required to achieve effective adhesion and sealing of the tape to said road surface. The reinforcement also means that the tape cannot be readily handled after its removal and presents a problem with regard to carrying the used tape away as scrap and also with regard to recycling or reusing the material. Because the reinforcing net reduces the pliability of the road marking tape for temporary use, it is often preferred to use a primary coating to facilitate adhesion of the tape. This solution, however, is encumbered with other drawbacks, such as extra costs entailed by material, solvent, manufacture and placement, additional work involved when laying-out and removing the tape, and increased environmental problems due to the requirement of a solvent.

The object of the present invention is to provide a road surface marking tape for temporary use which is based on a base layer of non-cured or non-vulcanized soft elastomeric material and a reinforcing material which imparts to the base layer, and therewith to the tape as a whole, a firmness and tensile strength sufficient to facilitate handling of the tape, and to a method of laying-out and removing such tape while avoiding the drawbacks described in the introduction. To this end, the inventive marking tape is characterised by the characteristic features set forth in respective product Claims, while the inventive method is characterised by the method steps set forth in respective method Claims.

The inventive marking tape thus includes a base layer of soft, non-vulcanized or non-cured elastomeric material, and a reinforcing material embedded therein, said reinforcing material comprising short non-metallic fibres distributed essentially uniformly in the base layer.

The short fibres are present in an amount corresponding to 5–50% of the weight of the base layer. By "short" fibres is meant in this case primarily the opposite of "long" fibres and suitably a fibre length that corresponds to the thickness of the base layer or shorter than said thickness. With respect to the amount of fibres present in the reinforcing layer, the lower limit of 5% represents a limit at which the base layer, and therewith the tape as a whole, will have insufficient tensile strength and/or an excessively high rupture strain and thus having the behaviour of a viscous chewing gum-like material that is difficult to stretch and almost impossible to handle when laying-out the tape. The upper limit of 50% with respect to fibre content provides a base layer which can be handled relatively well and which is acceptably pliable at least at such high outdoor temperatures as those experienced in tropical regions. A fibre content above this upper limit, however, will greatly impair the suppleness, i.e. shapability, of the tape such that the tape can no longer be used as a road surface marking tape. The reinforcing material will preferably comprise fibres that have lengths generally between 0.5 and 5 mm, preferably between 1 and 3 mm, which has been found to provide an optimal compromise between different tape properties. The material will preferably comprise textile fibres, plastic fibres or carbon fibres. Textile fibres are preferred in most cases. A tape that has optimum strength properties when used in normal outdoor temperatures in a temperate climate is obtained when the fibres are present in an amount corresponding to 10–20% of the weight of the base layer.

The elastomeric material is suitably a non-vulcanized synthetic rubber of the acrylnitrile-butadiene type.

According to the inventive method of providing road surfaces with a temporary marking or signalising system with the aid of an inventive tape, the tape is unwound continuously from a tape roll with the aid of an appropriate mechanical tape-laying device. When the tape is to be removed at the end of said temporary period, the tape is frozen to a brittle state and disintegrated mechanically to powder form or to fragmentary state, and then swept up or removed in some other way. The steps of freezing the tape so that it disintegrates and the step of removing the disintegrated powdery material are both effected mechanically, preferably essentially at one and the same time in a single step. The frozen tape is disintegrated with the aid of a rotary steel brush or some corresponding device, and the powder, or fragments, are removed by suction.

The invention will now be described in more detail.

The road surface marking tape includes a base layer of soft elastomeric material, for instance calendered non-vulcanized rubber of the acrylnitrile-butadiene type. The base layer will have a thickness in the order of 0.5–0.7 mm and includes reinforcement material in the form of short fibres distributed over the whole of the base layer and orientated generally in the longitudinal direction of the tape, said longitudinal orientation of the fibres having been achieved by means of a calendering process in the manufacture of the tape. The inclusion of the thus orientated short reinforcement fibres surprisingly imparts to the tape a tensile strength and an ultimate breaking strength that are in the same order of magnitude as a tape that includes a reinforcement in the form of a coherent net layer or the like.

In addition to the aforedescribed base layer, the inventive tape also includes a reflective material, for instance glass micro-beads and/or white or yellow pigment. It lies within the concept of the invention to produce this layer in accordance with some earlier known technique, either with the glass micro-beads embedded or buried in the layer or covered by a transparent and colourless outer layer which has physical properties similar to those of the reflective layer, although it is also possible to integrate the reflective layer in the base layer as described in EP-A 0304405 and therewith incorporate both pigment and glass micro-beads in the base layer. However, in the case of the inventive tape it has been found beneficial to have a thin outer layer of polyurethane with pigment and with glass beads that form the light reflecting bodies both completely embedded and partially embedded in said polyurethane layer. The tape also includes an appropriate adhesive layer, for instance a layer of butylpolyisobutene solution, to facilitate adhesion of the tape to the road surface for instance, when laying-out the tape.

The total thickness of the tape, including base layer, reflective layer, surface layer and adhesive layer, is between 1 and 1.5 mm, normally about 1.2 mm.

The inventive tape will normally not require the assistance of a primer in order to adhere effectively to the road surface, although a primer may be required in cold weather for instance. Because the tape is based on an elastomeric material that is extremely supple and therewith naturally pliable and capable of conforming to irregularities in the road surface, this suppleness not being affected to any great extent by the short non-metallic fibres distributed in the elastomeric material, the tape can be readily shaped or moulded to the underlying road surface and therefore will seal and adhere optimally to said surface. The limited requirement of a primer means that not as much solvent will be used, which is a significant environmental benefit. Distinct from marking tapes of this kind known hitherto, the inventive tape can be readily removed from said surface and collected mechanically when there is no longer any need for the temporary road marking. This mechanical removal and collection of the tape can be achieved in a manner which is highly effective and which is also much safer from a working aspect than all manual alternatives, which are always, of course, dangerous on traffic highways and roads. Removal of the marking tape can also be achieved much more quickly and with a smaller working force than when done manually.

The collected, finely-divided scrap material can be readily removed for recycling purposes and/or for reuse processing.

What is claimed is:

1. A method of marking road surfaces temporarily with the aid of marking tape, the method comprising laying-out the tape in the form of an elongated web taken from a tape reel with the aid of an appropriate mechanical tape applicator, wherein the tape comprises a base layer of non-vulcanized or non-cured elastomeric material, and reinforcing material embedded in the base layer, wherein the reinforcing material is comprised of short fibers of non-metallic material having a length generally of between 0.5 and 5 mm and distributed generally uniformly in the base layer; and in that the short fibers are present in an amount corresponding to 5–50% of the weight of said base layer, and, when the tape shall be removed, freezing the tape to a brittle state, mechanically disintegrating said tape to a powder form and mechanically collecting said powder.

2. A method according to claim 1, characterised by freezing, disintegrating and collecting said tape material mechanically in one single step.

3. A method according to claim 2, wherein the step of disintegrating said tape is performed with the aid of a rotating steel brush or corresponding device.

4. A method according to claim 3, wherein the step of collecting the disintegrated tape is performed by suction.

5. A method according to claim 1, wherein the step of disintegrating said tape is performed with the aid of a rotating steel brush or corresponding device.

6. A method of marking road surfaces temporarily with the aid of marking tape, the method comprising laying-out the tape in the form of an elongated web taken from a tape reel with the aid of an appropriate mechanical tape applicator, wherein the tape comprises a base layer of non-vulcanized or non-cured elastomeric material and reinforcing material embedded in the base layer, wherein the reinforcing material is comprised of short fibers of non-metallic material having a length generally of between 0.5 and 5 mm and distributed generally uniformly in the base layer; and in that the short fibers are present in an amount corresponding to 5–50% of the weight of said base layer, and, when the tape shall be removed, freezing the tape to a brittle state, mechanically disintegrating said tape to a powder form and mechanically collecting said powder.

7. A method according to claim 6, wherein the steps of freezing, disintegrating and collecting said tape material are performed mechanically at essentially the same time.

8. A method according to claim 7, wherein the step of disintegrating said tape is performed with the aid of a rotating steel brush or corresponding device.

9. A method according to claim 6, wherein the step of disintegrating said tape is performed with the aid of a rotating steel brush or corresponding device.

10. A method according to claim 6, wherein the step of collecting the disintegrated tape is performed by suction.

11. A method according to claim 7, wherein the step of collecting the disintegrated tape is performed by suction.

12. A method according to claim 9, wherein the step of collecting the disintegrated tape is performed by suction.

* * * * *